US006138699A

United States Patent [19]

Su

[11] Patent Number: 6,138,699

[45] Date of Patent: Oct. 31, 2000

[54] ANTI-SLIP BASE FOR A CRUTCH

[75] Inventor: Dickson Su, Taipei Hsien, Taiwan

[73] Assignee: Max Health Corporation, Taipei, Taiwan

[21] Appl. No.: 09/188,258

[22] Filed: Nov. 10, 1998

[51] Int. Cl.[7] ..... A45B 9/04

[52] U.S. Cl. ..... 135/82; 135/68; 135/77; 135/84; 135/86

[58] Field of Search ..... 135/77, 82, 84, 135/86, 68

[56] References Cited

U.S. PATENT DOCUMENTS 2,910,995 11/1959 Jacuzzi ..... 135/77
4,135,536 1/1979 Willis ..... 135/84
4,630,626 12/1986 Urban ..... 135/84

FOREIGN PATENT DOCUMENTS 3508347 9/1986 Germany ..... 135/77

*Primary Examiner*—Robert Canfield
*Attorney, Agent, or Firm*—Bacon & Thomas

[57] ABSTRACT

An anti-slip base for a crutch including a frustro-conical body having a recess at a bottom end thereof, a ball-shaped housing arranged on a top end of the frustro-conical body, a raised camber formed inside the recess with an anti-slip surface thereon, an outlet passage extending between the ball-shaped housing and the anti-slip surface on the raised camber, and a plurality of radial slots formed in a bottom face of the body.

9 Claims, 9 Drawing Sheets

ANTI-SLIP BASE FOR A CRUTCH

BACKGROUND OF THE INVENTION

1. Field of the Invention

The present invention relates to an anti-slipping base configuration for a walking aid crutch and, more particularly, to a configuration of the base which has improved anti-slipping capacity.

2. Description of the Related Art

The known configuration with regard to an anti-slipping base of a walking aid crutch, as shown in FIGS. 8 and 9, consists of a base 2, an upholding pole 3, and a mantle 4. At the top of the base 2, there is a cavity 21 for engaging with the ball-shaped end piece 31 at the end of the upholding pole 3. The end piece 31 is coupled into the central opening 41 on the mantle 4 in such a way that the screw holes 42 in the back surface of the mantle 4 will align with the perforated slots 22 on the base. The mantle 4 and the base 2 are thus integrated together and become one complete set upon inserting screw 43, from bottom to top, through the perforated slot 22. The screw 43 is then locked into the screw hole 42 so as to have the ball-shaped end piece revolvably engaged in the said cavity. In this way, when a cripple is walking on a bumpy road with the walking aid crutch, then the upholding pole on the crutch will be able to follow the lay of road by changing its supporting angle moderately. On the bottom of the above base 2 there is a cove, or recess 23 and a scupper, or drain 24 extending downward through the bottom of the cavity 21.

In the known configuration, the mantle 4 is made from a hard material while the base 2 is made from soft material. Consequently, after locking the screw into the mantle from the base, the mantel will crack easily at the joint of mantle on using it. When the base is alighting on the ground, the mantle is also tilting from side to side with the crutch. Thus, a dissociative force is created amid the two different kinds of material and the grasping force on the screw that is used for securing the mantle upward is reduced. Consequently, the mantle will not only crack easily, but also lose its function accordingly.

Furthermore, while the bottom surface of the illustrated base includes three respective radial slots, other configurations may not. Consequently, the rubber material on the base may become slippery when it is touching water. Also, since only part of the base will be touching the ground at the beginning of the motion, a water bubble may be formed at the time when the whole round base touches the water completely. Thus, the whole base will become slippery and result in the user losing his barycenter. Accordingly, the walking aid crutch is turned into an unsafe product for the cripple. In view of these two major defects described above for the known crutch, it is desired to develop and invent a new anti-slipping base configuration for the walking aid crutch.

SUMMARY OF THE INVENTION

The preferred purpose of the invention is to provide an anti-slipping base configuration for a walking aid crutch which has improved associativity of the base and the anti-skid characteristic for the bottom surface of the base as well. More particularly, the device maintains its superior anti-slipping performance when it touches a slippery surface with water on it so as to promote safety. Moreover, the area of tangency is enlarged so as to improve the associativity between the base and the secured round cover in order that the whole structure can be locked properly and firmly.

For this purpose, the invention has a configuration which comprises the base, the upholding pole, and the round cover, etc. On the top of the base, there is a ball-shaped housing for engaging with the ball-shaped end piece which is at the end of the upholding pole. A round cover is coupled with the base and a sleeve mounted onto the upholding pole so as to engage into the stick. In use, the base will be able to enlarge at the ground contracting area by having the circumference, which is near the bottom surface on the base, expand outward and turn into a dome-shape. Furthermore, screws are inserted through the holes on the round cover and then locked into nuts that are mounted on the base. On the bottom surface, there is a raised camber mounted on the base in order to provide an outlet between the base and the ball-shaped housing. There are also a few anti-slipping protuberant granules or rings mounted onto the raised camber. A deep slot is arranged between the circumference of the raised camber and the circumference of the flat bottom. There are also some radial slots which are positioned on the circumferential portion of the base but separated from one another.

BRIEF DESCRIPTION OF THE SEVERAL VIEWS OF THE DRAWINGS

The preferred embodiments of the invention will now be described by way of example with reference to the accompanying drawings, according to which.

DETAILED DESCRIPTION OF THE PREFERRED EMBODIMENT

Figure 1:
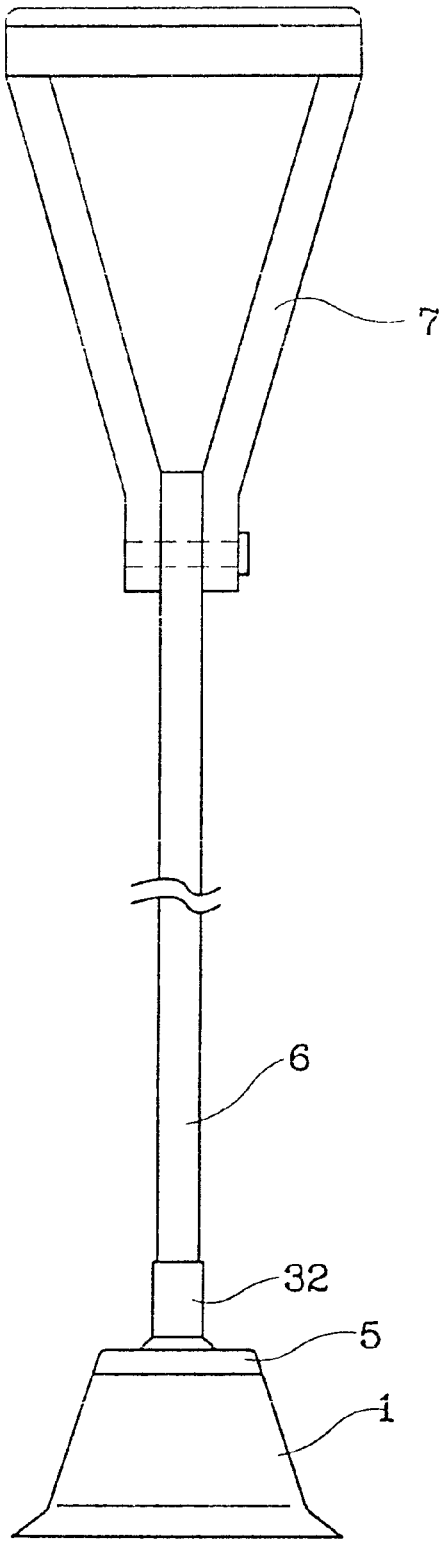
FIG. 1 is a side view of the present invention fitted on a crutch.
Figure 2:
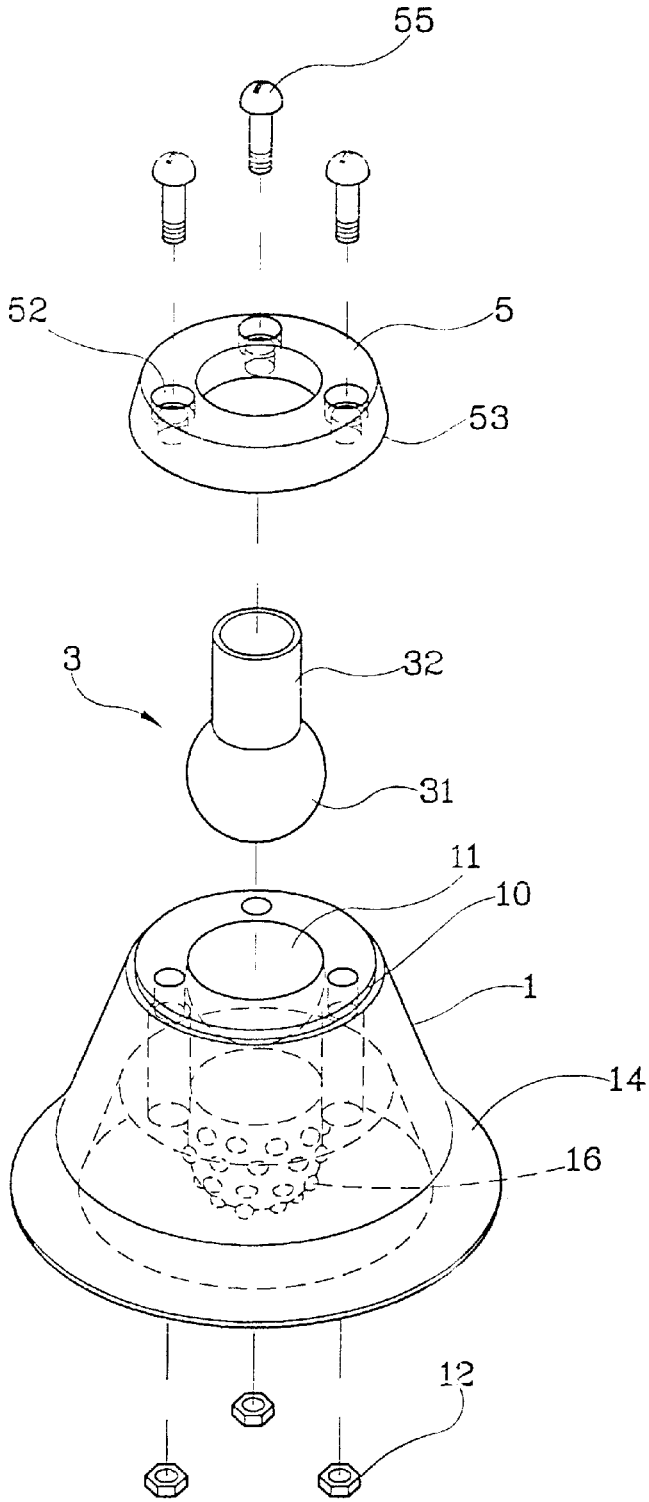
FIG. 2 is an exploded view of the present invention.
Figure 3:
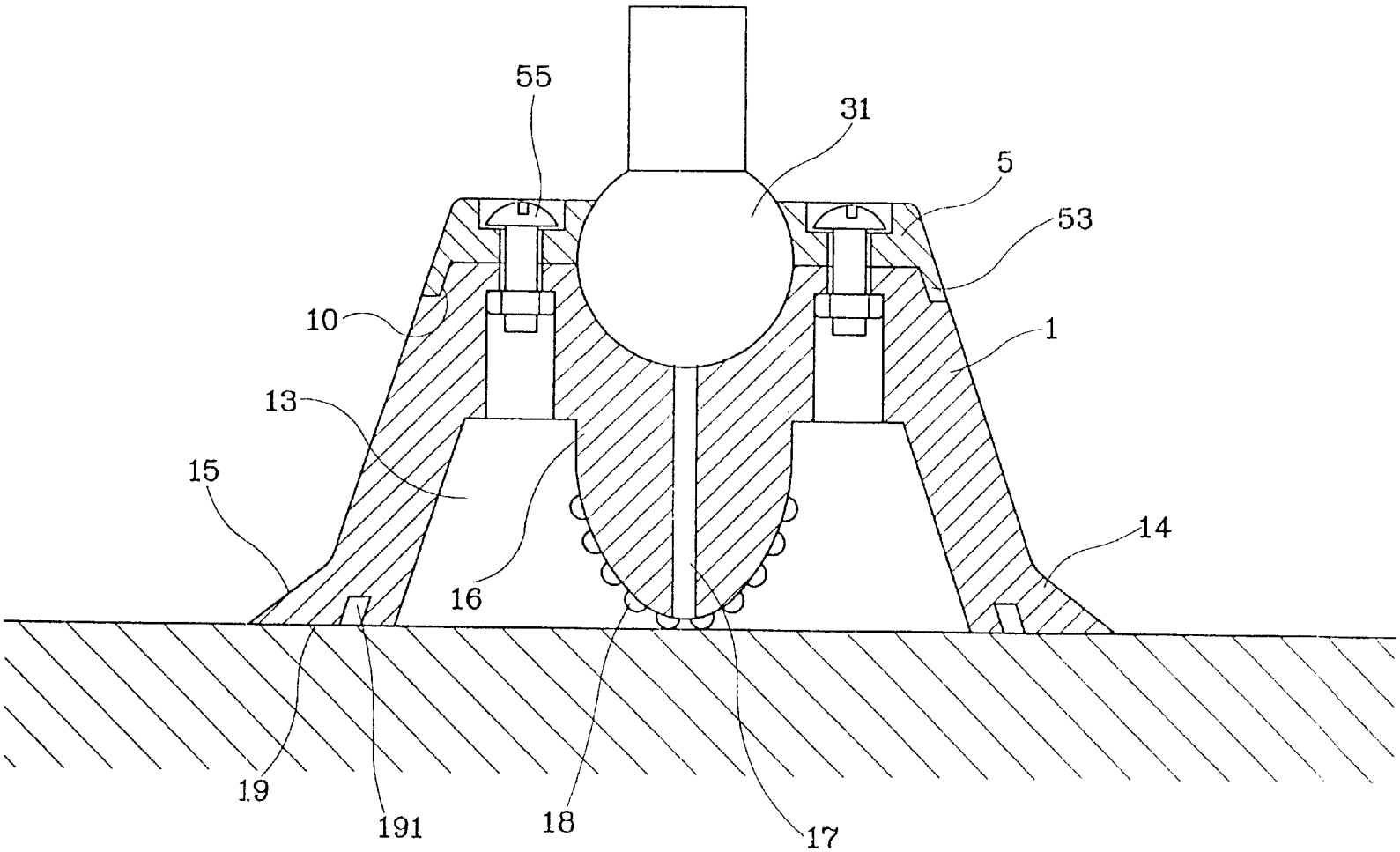
FIG. 3 is a cross-sectional view of the present invention.

With reference to FIGS. 1–7, the present invention for an anti-slipping base configuration for use with a walking aid crutch comprises a base 1 which is positioned at the bottom end of a crutch 7 having an upholding pole 3 and a round cover 5 on the top of the base 1. There is a ball-shaping housing 11 for engaging with the ball-shaped end piece 31, at the end of the upholding pole 3, with the round cover. The base is coupled there at sleeve 32 mounted onto the upholding pole 3 so as to engage into the bottom end of the stick 6. Normally, the base 1 is made from a rubber material and the circumference 14 is tilted in order to allow the circumference 15 which is near the bottom surface to become expandable and turn into a dome-shape so as to enlarge the contacting area. Screws 55 are inserted through the holes 52 on the round cover 5 and then locked into the nuts 12 mounted on the base 1. On the bottom surface, there is a raised camber 16 provided with an outlet 17 between the raised camber 16 and the ball-shaped housing.

Figure 6:
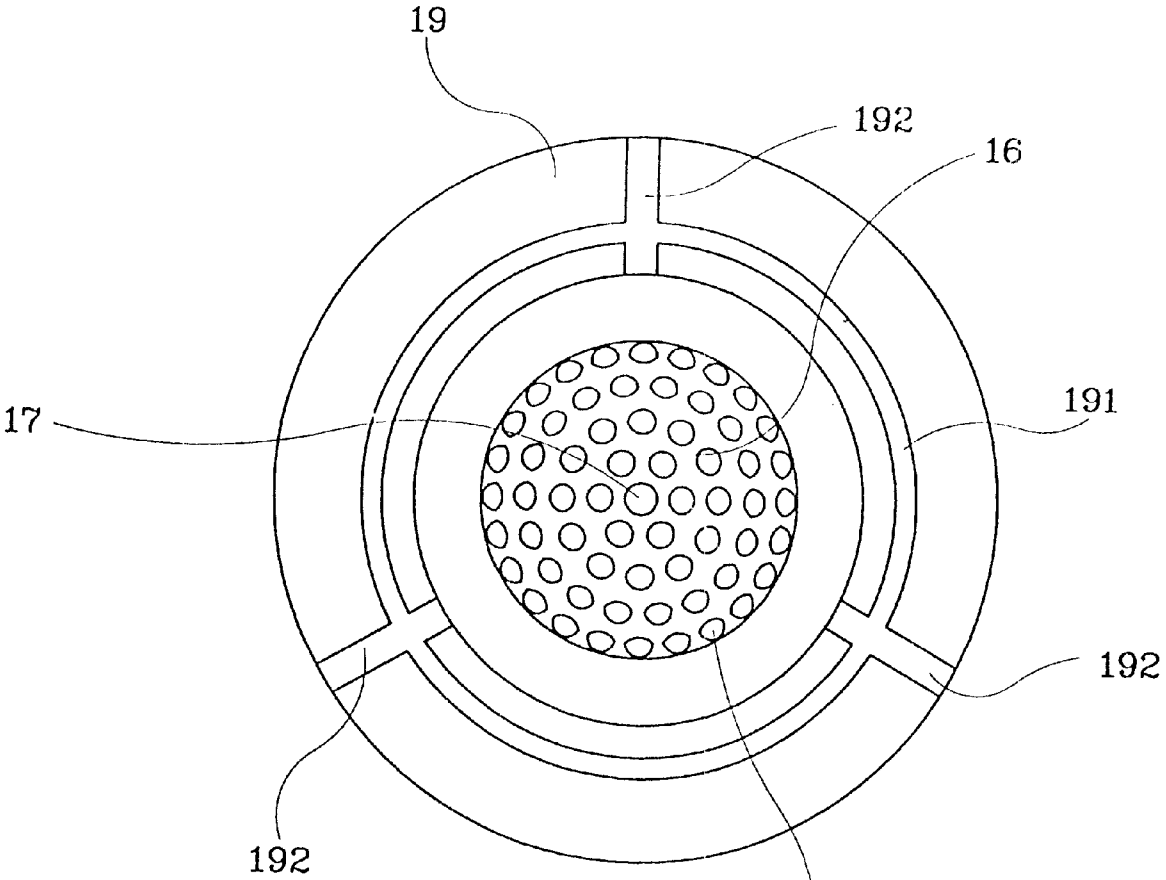
FIG. 6 is a bottom view of the present invention.
Figure 7:
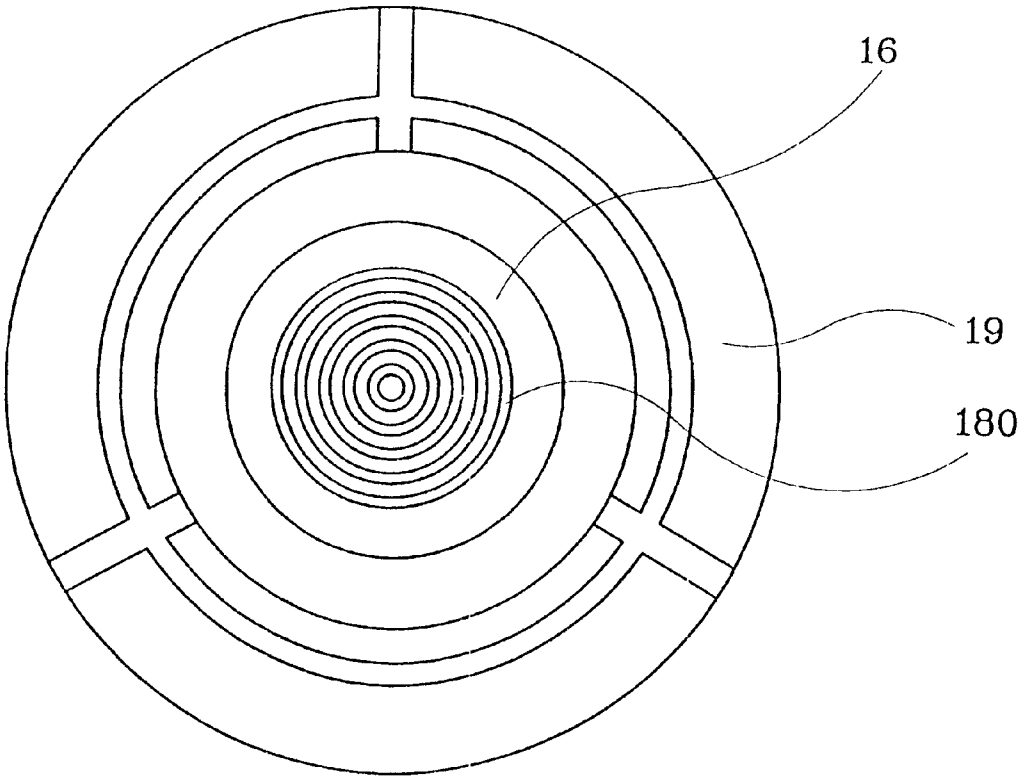
FIG. 7 is a bottom view of another embodiment of the present invention.
Figure 8:
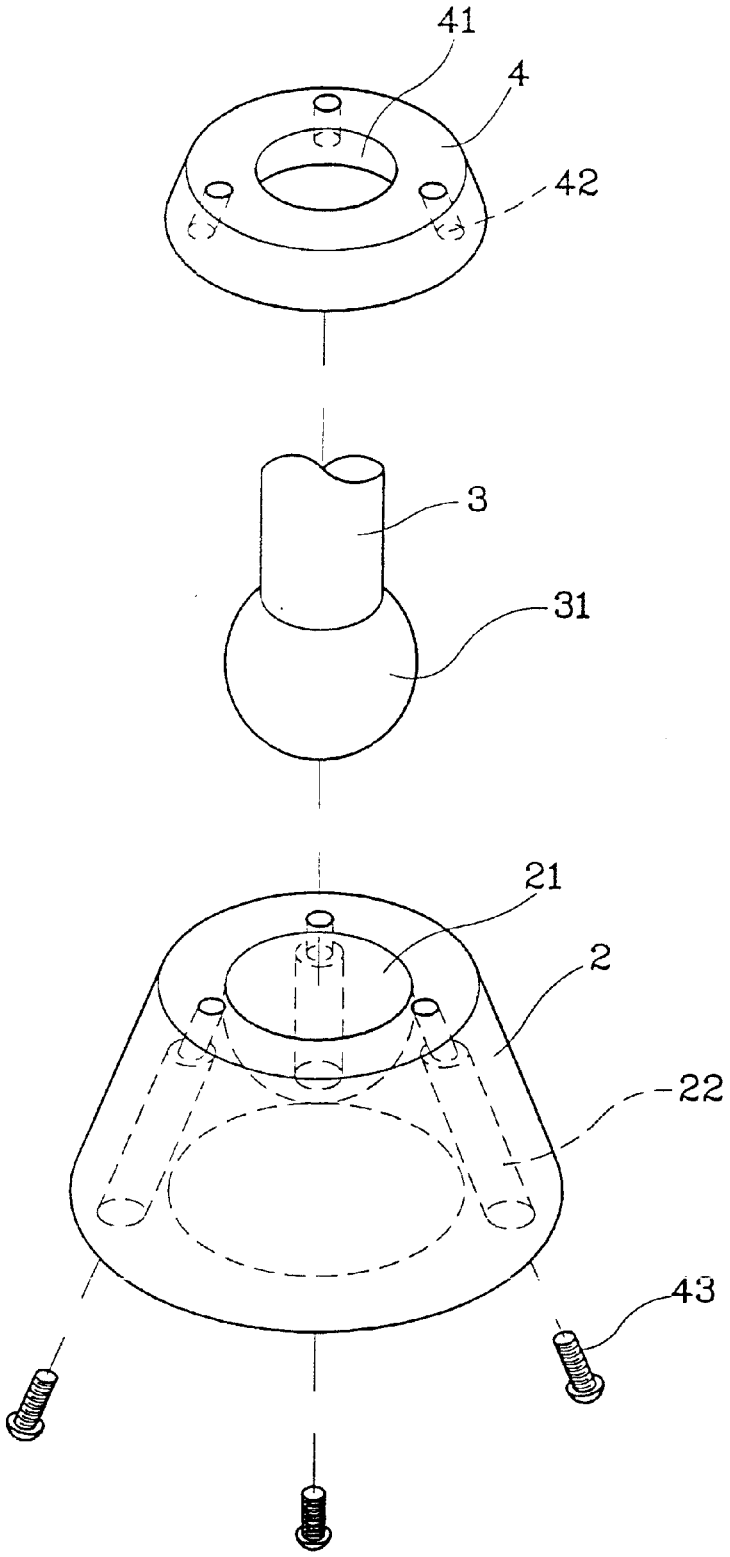
FIG.8 (PRIOR ART)
FIG. 8 is an exploded view of a conventional embodiment.
Figure 9:
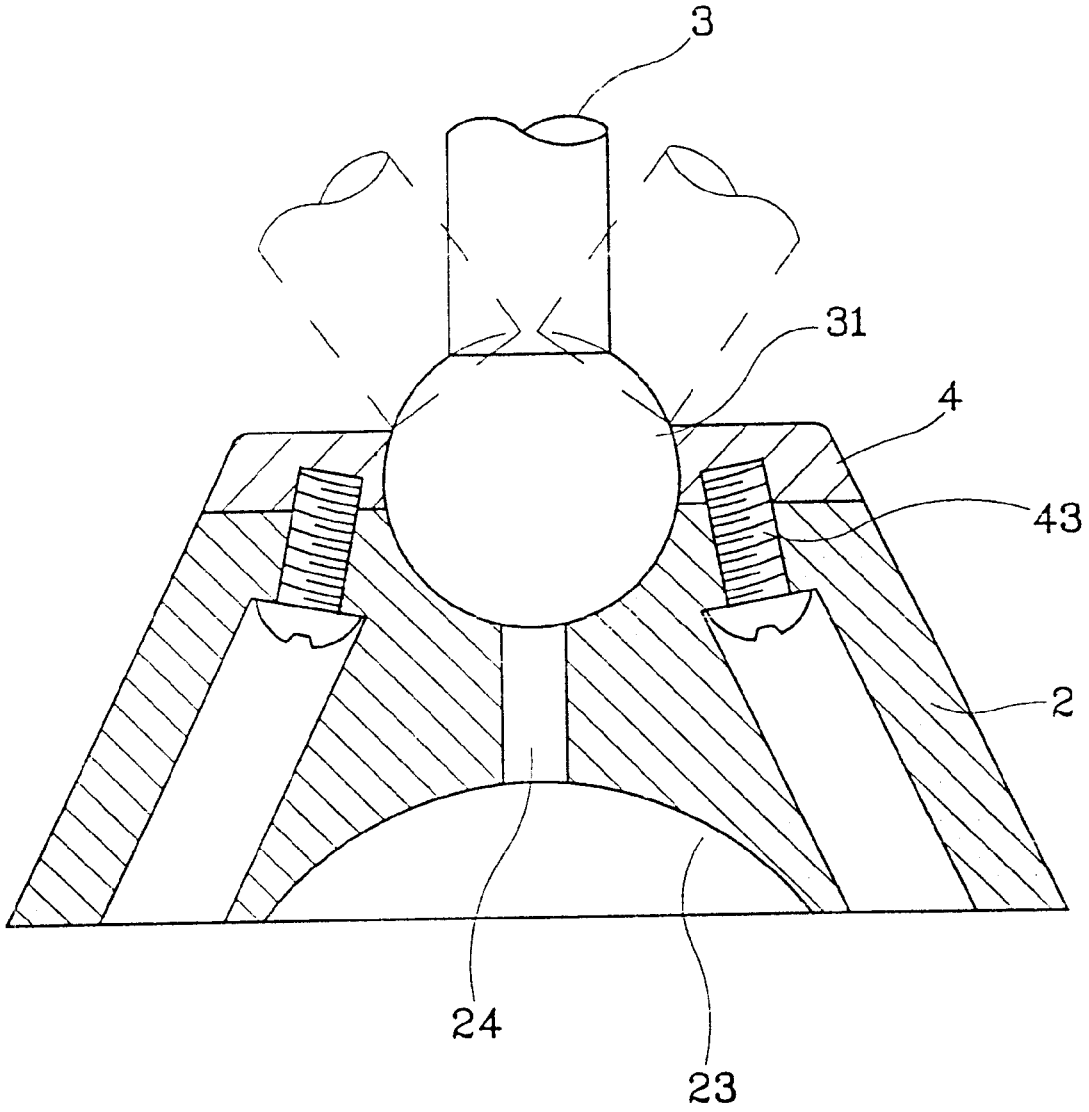
FIG. 9 (PRIOR ART)
FIG. 9 is a cross section view of the conventional embodiment shown in FIG. 8.

Moreover, there are some protuberant granules 18 on the camber 16. As shown in FIG. 6, it is acceptable to arrange the protuberant granules into a few circles of about 4 to 5 rings. The protuberant granules are preferably the same height as the bottom surface of the ball-shaped housing and all the protuberant granules may be appropriately truncated. Rings 180 may alternatively be mounted onto the raised camber as shown in FIG. 7. A deep slot 13 between the circumference of the raised camber and the perimeter of the flat bottom helps both the nuts and the base be easily and firmly integrated together. There is a lap of superfissure, or slots 191 positioned on the circumferential portion 19 of the base1 which is provided with radial slots 192 that are spaced apart from one another. The periphery on the top of the base 1 is equipped with a lap of chamfer, or shoulder 10 in order that the flange 53 on the lower ring at the bottom surface of the round cover 5 can be secured in order to cover the top on portion of the base accordingly.

Figure 4:
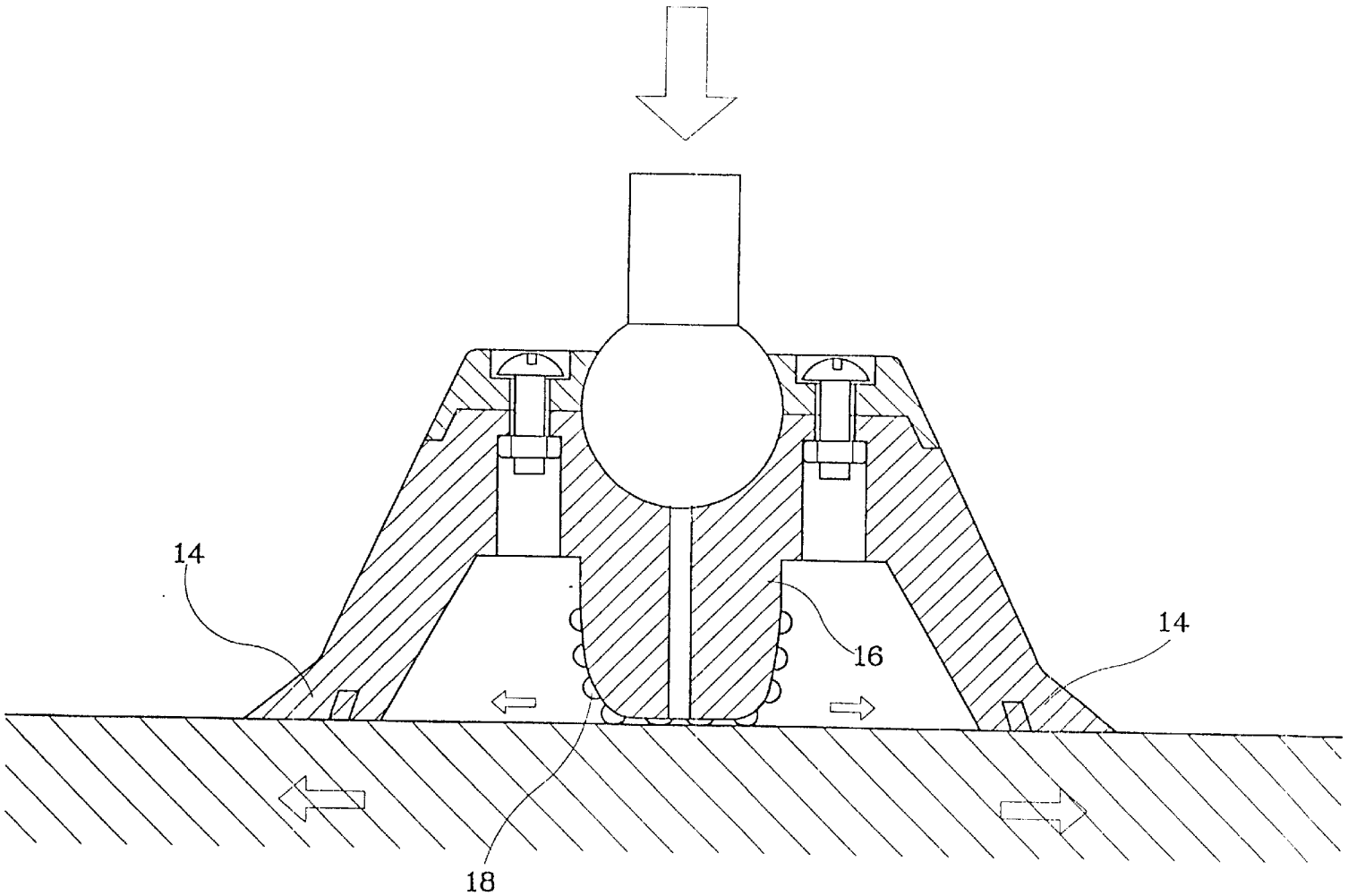
FIG. 4 is a cross section view of the present invention under downward compression.
Figure 5:
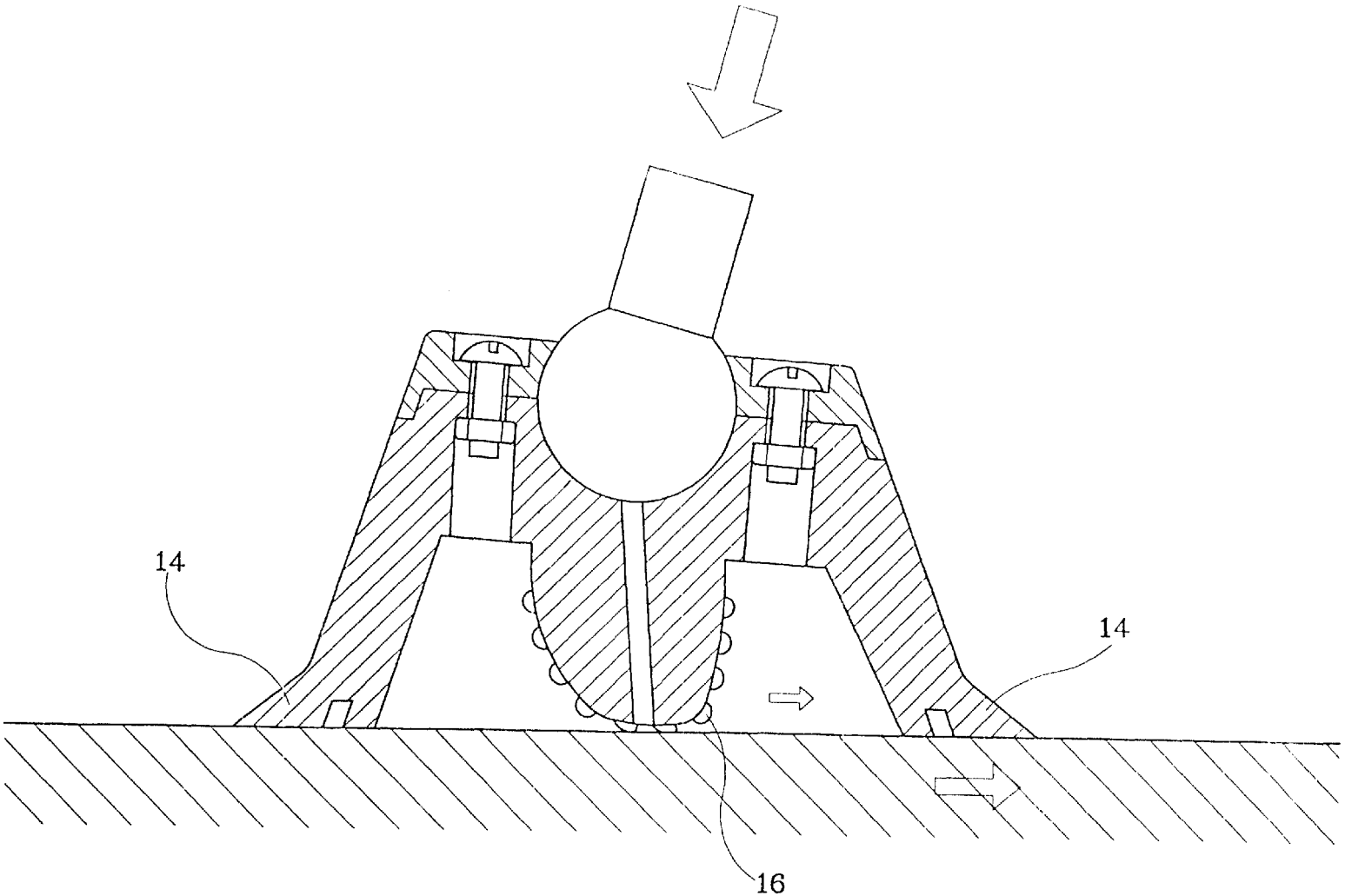
FIG. 5 is a cross-sectional view of the present invention under lateral and downward compression.

The flange is advantageously secured onto the top of the base in order to improve the fastening. Moreover, the flange improves the appearance of the product as well because the screws are locked upward from the bottom. This arrangement not only prevents the ends of the screws from extending out of the base but also strengthens the fastening force of the screws in order to prevent the flange from cracking. In addition, in order to enlarge the bottom area on the base so as to increase the tangential force in a wet surface, there are protuberant granules mounted onto the center portion of the bottom surface with different lengths depending on the curve of surface. The short granules are generally harder than the long ones so that under the down-depressed condition, as shown in FIG. 4, the contacting area is expanded and the ground contact is more secure with less possibility of slipping. The result is that, as shown in FIG. 5, the depressed portion of the domed-shaped section 15 changes shape only slightly. Additionally, while tilting the protuberant granules on the central part produce a resistance wherein a much greater tangential force may be applied. Consequently, while walking on the wet ground, the anti-slipping performance of the present invention is superior to the known product and is more suitable to be used on iced surfaces. In view of the above, use of the base provided from the present invention will have good anti-slipping performance and will also provide a high level of security. In addition, it has an integrated structure and is much easier to use than the known configuration.

Although preferred embodiments have been disclosed, other embodiments and modifications of the invention are intended to be covered by the spirit and scope of the appended claims.

What is claimed is:

1. An anti-slipping base for a walking aid crutch with an upholding pole, said base comprising:

a ball-shaped housing at a top of the base for engaging with a ball-shaped end piece with a sleeve which is at an end of the upholding pole;

a round cover coupled with the base wherein the sleeve is mounted onto the upholding pole so as to engage the pole;

a circumference, which is near the bottom surface on the base and expanded outward to create a dome-shape;

screws arranged in holes on the round cover and secured with nuts that are mounted on the base;

a raised camber on the bottom surface of the base;

an outlet between the raised camber and the ball-shaped housing;

a plurality of anti-slipping protuberant granules or rings mounted onto the raised camber;

a deep slot in-between the circumference of the raised camber and the circumference of the flat bottom; and a plurality of radial slots positioned on the circumference of the flat bottom and separated from one another.

2. An anti-slipping base configuration for the walking aid crutch as recited in claim 1 wherein, the protuberant granules are arranged in a circular pattern.

3. An anti-slipping base configuration for the walking aid crutch as recited in claim 2 wherein the protuberant granules are connected to each other to form concentric circles.

4. An anti-slipping base configuration for the walking aid crutch as recited in claim 1 wherein, a circumference on the top of the base is formed with a shoulder for receiving a flange.

5. An anti-slip base for a crutch, comprising:

a frustro-conical body having a recess at a bottom end thereof;

a ball-shaped housing arranged on a top end of the frustro-conical body;

a raised camber formed inside the recess with an anti-slip surface thereon;

an outlet passage extending between the ball-shaped housing and the anti-slip surface on the raised camber; and a plurality of radial slots formed in a bottom face of the body.

6. The anti-slip base for a crutch as recited in claim 5 wherein said anti-slip surface on the raised camber includes a plurality of protuberant granules.

7. The anti-slip base for a crutch as recited in claim 5 wherein said anti-slip surface on the raised camber includes a plurality of protuberant concentric rings.

8. The anti-slip base for a crutch as recited in claim 5 wherein the top end of the body includes a peripheral shoulder.

9. The anti-slip base for a crutch as recited in claim 8 further comprising a round cover with a peripheral flange for mating with the peripheral shoulder.

* * * * *